US007004458B1

(12) United States Patent
Grubba et al.

(10) Patent No.: US 7,004,458 B1
(45) Date of Patent: Feb. 28, 2006

(54) FENCE BOTTOM SHIELD

(76) Inventors: Karen Grubba, 20368 Anita St., Harper Woods, MI (US) 48225; Mark A. Grubba, 20368 Anita St., Harper Woods, MI (US) 48225

( * ) Notice: Subject to any disclaimer, the term of this patent is extended or adjusted under 35 U.S.C. 154(b) by 113 days.

(21) Appl. No.: 10/828,863

(22) Filed: Apr. 21, 2004

(51) Int. Cl.
*E04H 17/00* (2006.01)

(52) U.S. Cl. ..... 256/1; 256/32; 256/19

(58) Field of Classification Search ..... 256/1, 256/381, 59, 32–35, 45, 24; 52/800.12, 800.11, 52/800.1, 800.17, 716.8, 592.5, 592.6, 578, 52/581, 588.1, 589.1; 403/87, 294, 298
See application file for complete search history.

(56) References Cited

U.S. PATENT DOCUMENTS

| | | | | |
|---|---|---|---|---|
| 3,691,373 A * | 9/1972 | Compton et al. | ..... | 250/326 |
| 3,713,624 A | 1/1973 | Niemann | | |
| 3,768,780 A | 10/1973 | Cowles et al. | | |
| 3,991,980 A | 11/1976 | Blackburn | | |
| 4,497,472 A | 2/1985 | Johnson | | |
| 4,548,388 A | 10/1985 | Cobler | | |
| 4,907,783 A | 3/1990 | Fisk et al. | | |
| 5,535,545 A * | 7/1996 | Matz | ..... | 47/33 |
| 5,615,866 A | 4/1997 | Kinnison | | |
| D413,397 S | 8/1999 | Benjamin | | |
| 6,561,491 B1 * | 5/2003 | Thompson et al. | ..... | 256/1 |

* cited by examiner

*Primary Examiner*—Daniel P. Stodola
*Assistant Examiner*—Nahid Amiri

(57) ABSTRACT

Fence bottom shields prevent grass and weeds from growing up through the links or low openings in a fence. Two embodiments are disclosed. The first embodiment comprises a first strip and a second strip whose bottoms are integrally connected. Two end tabs are attached to one end of the first strip and the second strip, and a tab receiving slot is defined by the opposing end of the first strip and the second strip. A plurality of screw holes are defined by holes in the end tabs and the sidewalls of the first strip and second strip. Two fence bottom shields can be joined by inserting the end tab into the tab receiving slot and inserting two screws into the screw holes. The second embodiment comprises a first strip connected to a second strip by a bottom tab inserted into a bottom slot that is secured by a bolt and nut. Two end tabs are attached to one end of the first strip and the second strip, and a tab receiving slot is defined by the opposing end of the first strip and the second strip. Two fence bottom shields can be joined by snapping together the end tabs and the tab receiving slot. In both embodiments, a fence slot is defined by the sidewalls of the first strip and second strip.

7 Claims, 5 Drawing Sheets

FENCE BOTTOM SHIELD

BACKGROUND OF THE INVENTION

1. Field of the Invention

The present invention relates to a fence bottom shield for use in connection with lawn care. The fence bottom shield has particular utility in connection with preventing grass and weeds from growing up through the links or low openings in a fence.

2. Description of the Prior Art

Fence bottom shields are desirable for preventing grass and weeds from growing up through the links or low openings in a fence. Fences are a common feature of landscaping. Unfortunately, cutting grass and other vegetation that grows at the base of fences can be difficult because the fence impedes lawnmowers and has a tendency to cut and break the line of line trimmers. Fence bottom shields overcome these difficulties by preventing the growth of vegetation at the base of fences and by covering the lower end of the fence so that the line of a line trimmer is not broken by contact with the fence.

The use of vegetation barriers for fencing is known in the prior art. For example, U.S. Pat. No. 5,615,866 to Kinnison discloses a vegetation barrier for fencing. However, the Kinnison '866 patent does not have end tabs, and has further drawbacks of lacking a provision for linking together multiple vegetation barriers for fencing.

U.S. Pat. No. 4,497,472 to Johnson discloses a vegetation blocking fence edging assembly that inhibits the growth of vegetation. However, the Johnson '472 patent does not have a tab receiving slot, and additionally does not have screws that pass through the fence to which it is attached.

Similarly, U.S. Pat. No. 4,907,783 to Fisk et al. discloses a chain link fence edging and trimming attachment that allows a line trimmer to cut grass up to a fence without consuming excess line. However, the Fisk et al. '783 patent does not have end tabs, and cannot be connected to another chain link fence edging and trimming attachment.

In addition, U.S. Pat. No. 3,991,890 to Blackburn discloses a fence border guard that blocks the open areas below a wire fence. However, the Blackburn '980 patent does not have end tabs, and also does not have a provision for linking together multiple fence border guards.

Furthermore, U.S. Pat. No. 4,548,388 to Cobler discloses a fence protector that restricts the growth of grass, weeds, and the like directly adjacent to or beneath a fence line. However, the Cobler '388 patent does not have end tabs, and further lacks a tab receiving slot.

U.S. Pat. No. 3,713,624 to Niemann discloses a fence guard that restricts the growth of grass, weeds, and the like directly adjacent to or beneath a fence. However, the Niemann '624 patent does not have screws, and has the additional deficiency of lacking end tabs.

Furthermore, U.S. Pat. No. 3,768,780 to Cowles et al. discloses a fence border that eliminates the need for trimming grass under a fence and passage of animals under a fence. However, the Cowles et al. '780 patent does not have screws, and further lacks a provision for linking together multiple fence borders.

Lastly, U.S. Pat. No. Des. 413,397 to Benjamin discloses a fence vegetation barrier that restricts the growth of grass, weeds, and the like directly adjacent to or beneath a fence. However, the Benjamin '397 patent does not have end tabs, and has the additional deficiency of lacking a provision for linking together multiple fence vegetation barriers.

While the above-described devices fulfill their respective, particular objectives and requirements, the aforementioned patents do not describe a fence bottom shield that allows preventing grass and weeds from growing up through the links or low openings in a fence. The Kinnison '866 patent, the Fisk et al. '783 patent, the Blackburn '980 patent, the Cobler '388 patent, the Niemann '624 patent, and the Benjamin '397 patent make no provision for end tabs. The Kinnison '866 patent, the Fisk et al. '783 patent, the Blackburn '980 patent, the Cowles et al. '780 patent, and the Benjamin '397 patent lack a provision for linking themselves together. The Johnson '472 patent and the Cobler '388 patent do not have tab receiving slot. The Johnson '472 patent omits screws that pass through the fence to which it is attached. The Niemann '624 patent and the Cowles et al. '780 patent lack screws.

Therefore, a need exists for a new and improved fence bottom shield that can be used for preventing grass and weeds from growing up through the links or low openings in a fence. In this regard, the present invention substantially fulfills this need. In this respect, the fence bottom shield according to the present invention substantially departs from the conventional concepts and designs of the prior art, and in doing so provides an apparatus primarily developed for the purpose of preventing grass and weeds from growing up through the links or low openings in a fence.

SUMMARY OF THE INVENTION

In view of the foregoing disadvantages inherent in the known types of vegetation barriers for fencing now present in the prior art, the present invention provides an improved fence bottom shield, and overcomes the above-mentioned disadvantages and drawbacks of the prior art. As such, the general purpose of the present invention, which will be described subsequently in greater detail, is to provide a new and improved fence bottom shield which has all the advantages of the prior art mentioned heretofore and many novel features that result in a fence bottom shield which is not anticipated, rendered obvious, suggested, or even implied by the prior art, either alone or in any combination thereof.

To attain this, the present invention essentially comprises a first strip with its bottom attached to the bottom of a second strip. A plurality of end tabs have one side attached to one end of the first strip and the second strip. The opposing end of the first strip and the second strip defines a tab receiving slot. The sidewalls of the first strip and the second strip define a fence slot. The end tabs in the sidewalls of the first strip and the second strip define a plurality of screw holes. A first screw and a second screw have one end inserted through the screw holes.

There has thus been outlined, rather broadly, the more important features of the invention in order that the detailed description thereof that follows may be better understood and in order that the present contribution to the art may be better appreciated.

The invention may also include the bottoms of the first strip and the second strip being integrally connected. The cross-section of the fence bottom shield may be generally α-shaped. The first strip and the second strip may be selected from the group consisting of plastic, steel, aluminum, titanium, wood, and carbon fiber composite. The first strip and the second strip may be about 6'2" long, 2 in. wide, and 6 in. high. The end of the first screw may define a screw receiving hole. The end of the second screw may be threadedly inserted into the screw receiving hole. A plurality of fence bottom shields may be removably connected to one another by inserting the end tabs into the tab receiving slot and inserting the first screw and the second screw through the screw holes. The fence slot may be adapted to receive the bottom of a chain-link fence. The invention may comprise a first strip with one side of a bottom tab and the bottom of a second strip attached to its bottom. The bottom of the second strip may define a bottom slot. A plurality of end tabs may have one side attached to one of the ends of the first strip and the second strip. The opposing end of the first strip and the second strip may define a tab receiving slot. The sidewalls of the first strip and the second strip may define a fence slot. The bottom of the first strip and the second strip may define a plurality of screw holes. A bolt may have one end inserted through the screw holes. A nut may be threadedly attached to the end of the bolt. A plurality of fence bottom shields may be removably connected to one another by snapping together the end tabs and the tab receiving slot. The bottom slot may be adapted to receive the bottom tab. The invention may be an improvement to a chain link fence. There are, of course, additional features of the invention that will be described hereinafter and which will form the subject matter of the claims attached.

Numerous objects, features, and advantages of the present invention will be readily apparent to those of ordinary skill in the art upon a reading of the following detailed description of presently current, but nonetheless illustrative, embodiments of the present invention when taken in conjunction with the accompanying drawings. In this respect, before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods, and systems for carrying out the several purposes of the present invention. It is important, therefore, that the claims be regarded as including such equivalent constructions insofar as they do not depart from the spirit and scope of the present invention.

It is therefore an object of the present invention to provide a new and improved fence bottom shield that has all of the advantages of the prior art vegetation barriers for fencing and none of the disadvantages.

It is another object of the present invention to provide a new and improved fence bottom shield that may be easily and efficiently manufactured and marketed.

An even further object of the present invention is to provide a new and improved fence bottom shield that has a low cost of manufacture with regard to both materials and labor, and which accordingly is then susceptible of low prices of sale to the consuming public, thereby making such fence bottom shield economically available to the buying public.

Still another object of the present invention is to provide a new fence bottom shield that provides in the apparatuses and methods of the prior art some of the advantages thereof, while simultaneously overcoming some of the disadvantages normally associated therewith.

Even still another object of the present invention is to provide a fence bottom shield for preventing grass and weeds from growing up through the links or low openings in a fence. This allows the user to operate a lawnmower or weed trimmer in close proximity to a fence.

Still yet another object of the present invention is to provide a fence bottom shield for preventing grass and weeds from growing up through the links or low openings in a fence. This makes it possible to improve the appearance of a fence.

An additional object of the present invention is to provide a fence bottom shield for preventing grass and weeds from growing up through the links or low openings in a fence. This allows the fence bottom shield to enclose the bottom of a fence.

A further object of the present invention is to provide a fence bottom shield for preventing grass and weeds from growing up through the links or low openings in a fence. This makes it possible to fit the fence bottom shield to any length of fence.

Lastly, it is an object of the present invention to provide a new and improved fence bottom shield for preventing grass and weeds from growing up through the links or low openings in a fence.

These together with other objects of the invention, along with the various features of novelty that characterize the invention, are pointed out with particularity in the claims annexed to and forming a part of this disclosure. For a better understanding of the invention, its operating advantages, and the specific objects attained by its uses, reference should be had to the accompanying drawings and descriptive matter in which there is illustrated current embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various figures.

DESCRIPTION OF THE CURRENT EMBODIMENT

Figure 1:
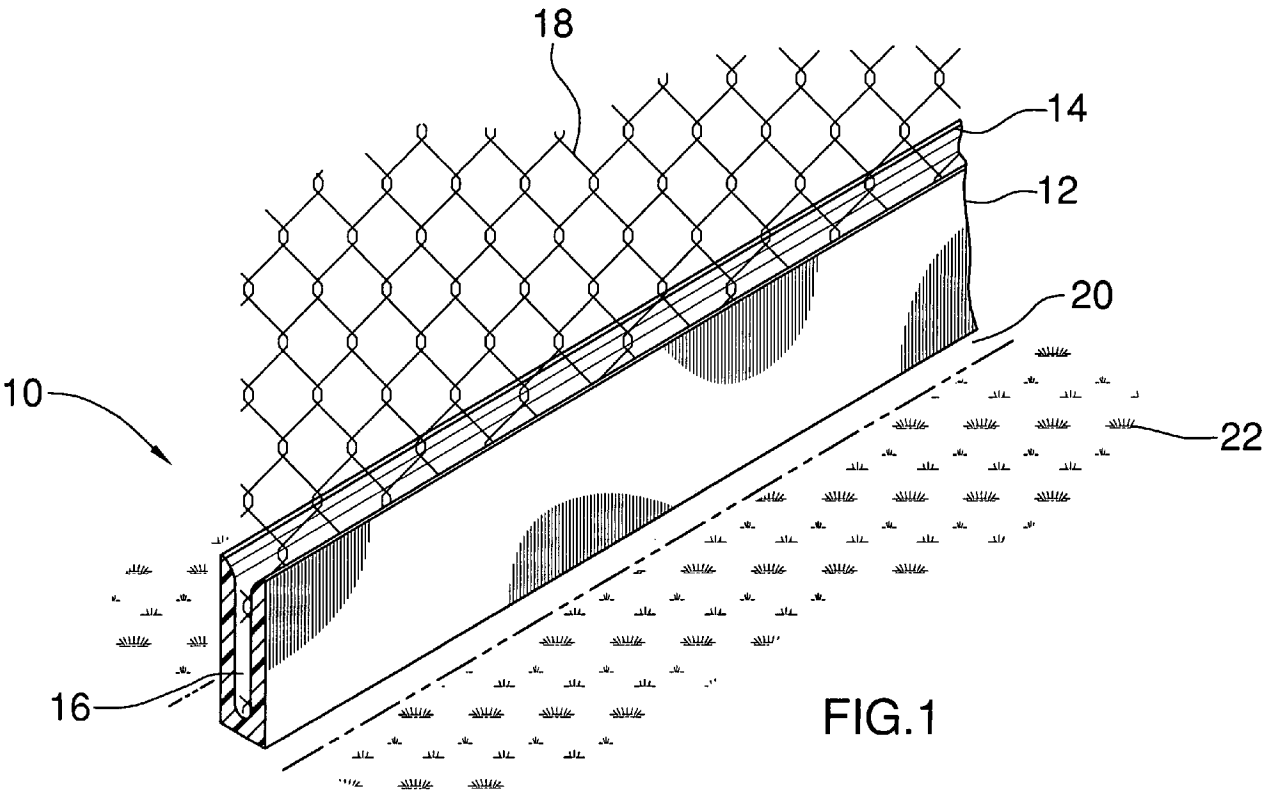
FIG. 1 is a top perspective sectional fragmentary view of the current embodiment of the fence bottom shield constructed in accordance with the principles of the present invention.

Referring now to the drawings, and particularly to FIGS. 1–6, a current embodiment of the fence bottom shield of the present invention is shown and generally designated by the reference numeral 10.

In FIG. 1, a new and improved fence bottom shield 10 of the present invention for preventing grass and weeds from growing up through the links or low openings in a fence is illustrated and will be described. More particularly, the fence bottom shield 10 is shown in use with the bottom of a chain-link fence 18 inserted into the fence slot 16 defined by the sidewalls of the first strip 12 and second strip 14. The fence bottom shield 10 has been placed on a level area 20 and impedes the growth of grass 22 underneath the chain-link fence 18. In the current embodiment, first strip 12 and second strip 14 are integrally connected, are made of plastic, and measure 6'2" long, 2 in. wide, and 6 in. high. Note that the chain-link fence 18, level area 20, and grass 22 are for illustrative purposes only and are not part of the current invention.

Figure 2:
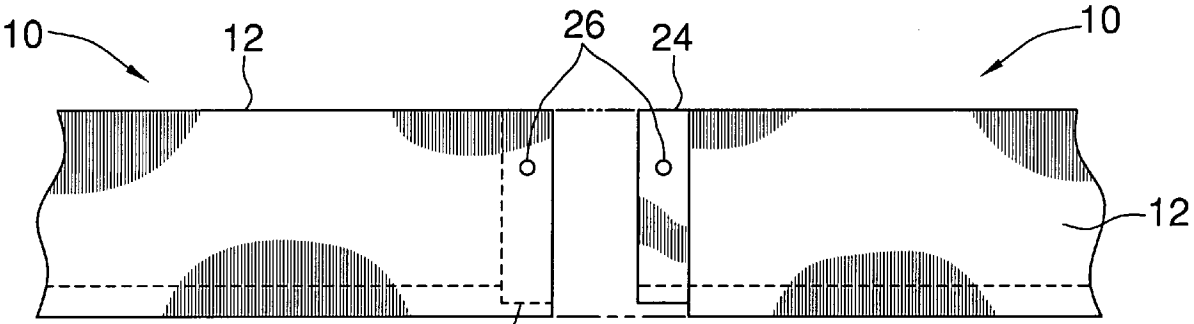
FIG. 2 is a side exploded view of the fence bottom shield of the present invention.

Moving on to FIG. 2, a new and improved fence bottom shield 10 of the present invention for preventing grass and weeds from growing up through the links or low openings in a fence is illustrated and will be described. More particularly, the fence bottom shield 10 can be joined together with additional fence bottom shields 10 to fit any length of chain-link fence 18 (not shown). This is accomplished by inserting the end tabs 24 (only one of which is visible) attached to one end of the first strip 12 and second strip 14 (not shown) into the tab receiving slot 34 (denoted by the broken lines) defined by the opposing end of the first strip 12 and second strip 14. Screw holes 26 are present in the end tabs 24 and the sidewall of the first strip 12 and second strip 14. After the end tabs 24 have been inserted into the tab receiving slot 34, the screw holes 26 overlap, allowing a first screw 28 (not shown) and a second screw 30 (not shown) to be inserted into the screw holes 26 to removably secure the ends of the fence bottom shields 10 together.

Figure 3:
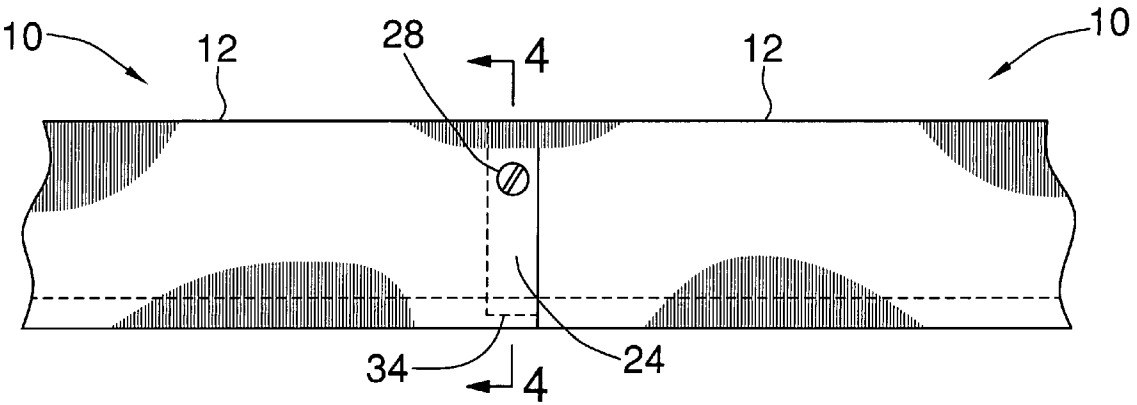
FIG. 3 is a side view of the fence bottom shield of the present invention.

Continuing with FIG. 3, a new and improved fence bottom shield 10 of the present invention for preventing grass and weeds from growing up through the links or low openings in a fence is illustrated and will be described. More particularly, the fence bottom shield 10 has been joined with another fence bottom shield 10 by having its end tabs 24 (only one of which is shown) inserted into the tab receiving slot 34 (not shown) defined by the opposing end of the first strip 12 and second strip 14 (not shown). After insertion of the end tabs 24 into the tab receiving slot 34 (denoted by the dotted lines), the screw holes 26 (not shown) in the end tabs 24 and sidewall of the first strip 12 and second strip 14 (not shown) overlap, thereby allowing a first screw 28 and second screw 30 (not shown) to be inserted into the screw holes 26 to removably secure the ends of the fence bottom shields 10 together.

Figure 4:
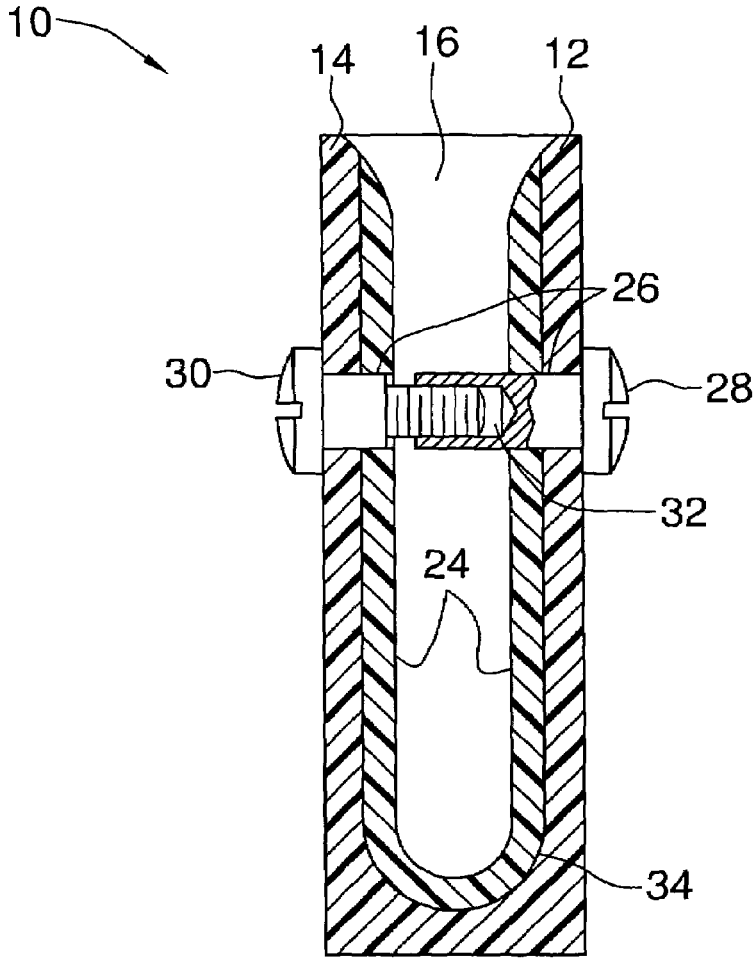
FIG. 4 is a front sectional view of the fence bottom shield of the present invention.

In FIG. 4, a new and improved fence bottom shield 10 of the present invention for preventing grass and weeds from growing up through the links or low openings in a fence is illustrated and will be described. More particularly, the fence bottom shield 10 has a first strip 12 and a second strip 14 with their bottoms integrally connected to form a generally U-shaped cross-section in the current embodiment. Two fence bottom shields 10 have their ends connected together by the insertion of end tabs 24 into tab receiving slot 34 and first screw 28 and second screw 30 into screw holes 26. One end of first screw 28 defines a screw receiving hole 32 therein. One end of second screw 30 is threadedly inserted into the screw receiving hole 32.

Figure 5B:
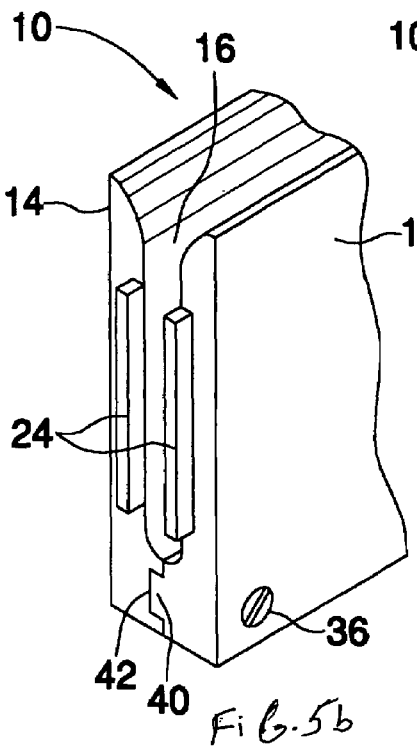
FIGS. 5*a* and 5*b* show a top perspective fragmentary view of an alternative embodiment of the fence bottom shield of the present invention.
Figure 5A:
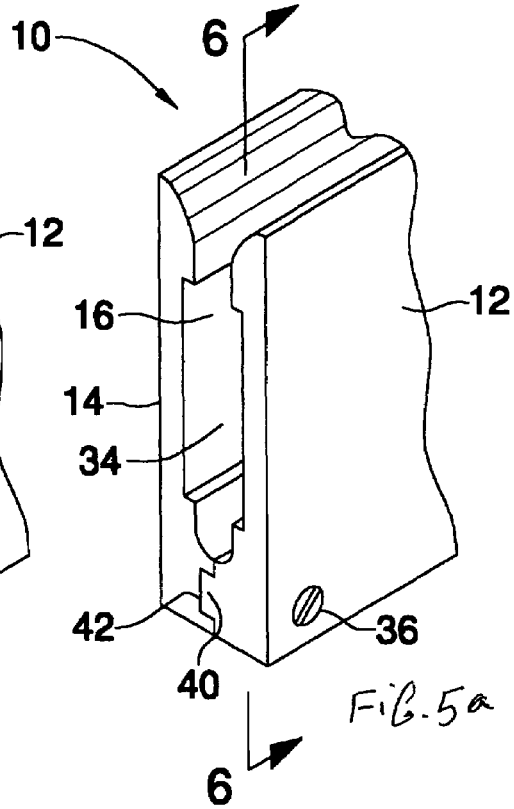

Furthermore, in FIGS. 5*a* and 5*b*, an alternative embodiment of a new and improved fence bottom shield 10 of the present invention for preventing grass and weeds from growing up through the links or low openings in a fence is illustrated and will be described. More particularly, the alternative embodiment of the fence bottom shield 10 has a first strip 12 that is attached to a second strip 14 by a bottom tab 40 inserted into a bottom slot 42 defined by the bottom of the second strip 14. A bolt 36 and a nut 38 (not shown) are inserted into screw holes 26 (not shown) in the bottom of the first strip 12 and second strip 14 to removably secure the bottoms of the first strip 12 and the second strip 14 to one another. One side of a plurality of end tabs 24 is connected to one end of the first strip 12 and second strip 14. The opposing end of the first strip 12 and second strip 14 defines a tab receiving slot 34 therein. The sidewalls of the first strip 12 and second strip 14 define a fence slot therein. In the current embodiment, first strip 12 and second strip 14 are made of plastic and measure 6'2" long, 2 in. wide, and 6 in. high, and the fence slot 16 is adapted to fit the bottom of a chain-link fence 18 (not shown). Two fence bottom shields 10 can be joined together by snapping together the end tabs 24 of one fence bottom shield 10 and the tab receiving slot 34 of another fence bottom shield 10.

Figure 6:
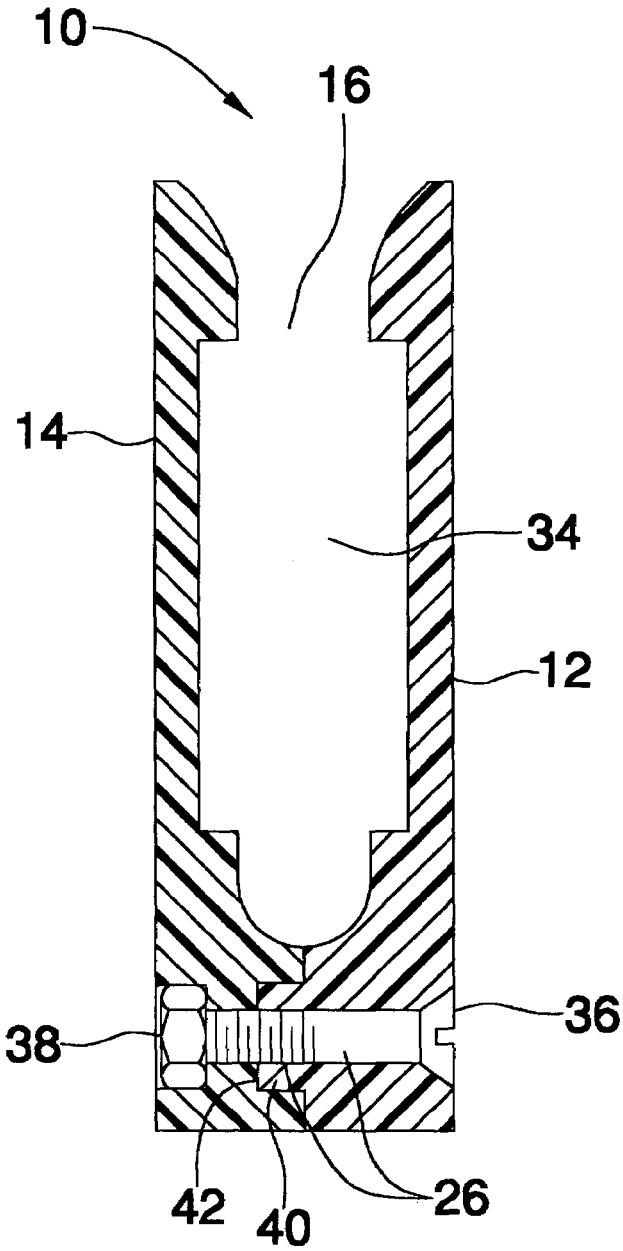
FIG. 6 is a rear sectional view of the alternative embodiment of the fence bottom shield of the present invention.

Concluding with FIG. 6, an alternative embodiment of a new and improved fence bottom shield 10 of the present invention for preventing grass and weeds from growing up through the links or low openings in a fence is illustrated and will be described. More particularly, the alternative embodiment of the fence bottom shield 10 has a first strip 12 connected to a second strip 14 by a bottom tab 40 inserted into a bottom slot 42. A bolt 36 and nut 38 inserted into screw holes 26 secure together the bottoms of the first strip 12 and second strip 14. The resulting fence bottom shield 10 is generally U-shaped in cross-section, and one end of the first strip 12 and second strip 14 defines a tab receiving slot 34 therein.

In use, it can now be understood that the user selects an embodiment of the fence bottom shield 10 to attach to the bottom of a chain-link fence 18. If the second embodiment is chosen, the user inserts bottom tab 40 into bottom slot 42 and secures it there with bolt 36 and nut 38. The user then removes the clips from the chain-link fence 18 and clears a level area 20 beneath the chain-link fence 18. The user then inserts the bottom of chain-link fence 18 into the fence slot 16. If additional fence bottom shields 10 are needed, the end tabs 24 of a first fence bottom shield 10 are inserted into the tab receiving slot 34 of a second fence bottom shield 10. If the first embodiment is selected, a first screw 28 is inserted through screw holes 26 and a second screw 30 is inserted through screw holes 26 and threadedly connected to the first screw 28 by the user. In the second embodiment, the end tabs 24 of the first fence bottom shield 10 snap together with the tab receiving slot 34 of the second fence bottom shield 10. Any excess length of fence bottom shield 10 can be cut off, including surplus end tabs 24. After installation of the fence shield 10, the user replaces the clips. As needed, the user can hose out the interior of the fence bottom shield 10 to keep it free of debris.

While a current embodiment of the fence bottom shield has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. For example, any suitable sturdy material such as steel, aluminum, titanium, wood, or carbon fiber composite may be used instead of the plastic first strip and second strip described. Also, the screws may be other types of fasteners. And although preventing grass and weeds from growing up through the links or low openings in a fence has been described, it should be appreciated that the fence bottom shield herein described is also suitable for covering the ends of a wide range of thin objects. Furthermore, a wide variety of cross-section shapes may be used instead of the generally U-shaped cross-section described.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A fence bottom shield comprising:

a first strip having opposing ends, a sidewall, and a bottom;

a bottom tab having opposing sides with one side attached to said bottom of said first strip;

a second strip having opposing ends, a sidewall, and a bottom with said bottom attached to said bottom of said first strip;

a bottom tab receiving slot, wherein said bottom of said second strip defines a slot therein to comprise said bottom tab receiving slot;

a plurality of end tabs having opposing sides with one side attached to one of said ends of said first strip and said second strip;

a tab receiving slot, wherein said opposing end of said first strip and said second strip defines a slot therein to comprise said tab receiving slot;

a fence slot, wherein said sidewalls of said first strip and said second strip define a slot therein to comprise said fence slot;

a plurality of screw holes, wherein said bottom of said first strip and said second strip defines holes therein to comprise said screw holes;

a bolt having opposing ends with one end inserted through said screw holes; and a nut threadedly attached to said end of said bolt.

2. The fence bottom shield as defined in claim 1, wherein the cross-section of said fence bottom shield is generally U-shaped.

3. The fence bottom shield as defined in claim 1, wherein said first strip and said second strip are selected from the group consisting of plastic, steel, aluminum, titanium, wood, and carbon fiber composite.

4. The fence bottom shield as defined in claim 1, wherein said first strip and said second strip are about 6'2" long, 2 in. wide, and 6 in. high.

5. The fence bottom shield as defined in claim 1, wherein a plurality of fence bottom shields can be removably connected to one another by snapping together said end tabs and said tab receiving slot.

6. The fence bottom shield as defined in claim 1, wherein said fence slot is adapted to receive the bottom of a chain-link fence.

7. The fence bottom shield as defined in claim 1, wherein said bottom slot is adapted to receive said bottom tab.

* * * * *